US010357869B2

(12) United States Patent
Debourdeau et al.

(10) Patent No.: US 10,357,869 B2
(45) Date of Patent: Jul. 23, 2019

(54) LUMINESCENT SUBSTRATE CONTAINING ABRASIVE PARTICLES, AND METHOD FOR THE PRODUCTION THEREOF

(71) Applicants: COMMISSARIAT A L'ENERGIE ATOMIQUE ET AUX ENERGIES ALTERNATIVES, Paris (FR); THERMOCOMPACT, Metz-Tessy (FR)

(72) Inventors: Mathieu Debourdeau, Cuzy (FR); Amal Chabli, Meylan (FR); Fabrice Coustier, Chambery (FR); Bruno Laguitton, Grenoble (FR); Jean-Pierre Simonato, Sassenage (FR)

(73) Assignees: COMMISSARIAT A L'ENERGIE ATOMIQUE ET AUX ENERGIES ALTERNATIVES, Paris (FR); THERMOCOMPACT, Metz-Tessy (FR)

( * ) Notice: Subject to any disclaimer, the term of this patent is extended or adjusted under 35 U.S.C. 154(b) by 0 days.

(21) Appl. No.: 15/763,011

(22) PCT Filed: Sep. 29, 2016

(86) PCT No.: PCT/EP2016/073177
§ 371 (c)(1),
(2) Date: Mar. 23, 2018

(87) PCT Pub. No.: WO2017/055394
PCT Pub. Date: Apr. 6, 2017

(65) Prior Publication Data

US 2018/0257200 A1 Sep. 13, 2018

(30) Foreign Application Priority Data

Sep. 30, 2015 (FR) ..... 15 59281

(51) Int. Cl.
*B24D 3/34* (2006.01)
*B24D 18/00* (2006.01)
*B24B 49/12* (2006.01)

(52) U.S. Cl.
CPC ..... *B24D 3/346* (2013.01); *B24D 3/34* (2013.01); *B24D 18/0018* (2013.01); *B24B 49/12* (2013.01)

(58) Field of Classification Search
CPC ..... B24D 3/346; B24D 3/34; B24D 18/0018; B24B 49/12
See application file for complete search history.

(56) References Cited

U.S. PATENT DOCUMENTS 4,399,167 A * 8/1983 Pipkin ..... C04B 20/1055 427/217
2002/0100469 A1* 8/2002 Shimazaki ..... B23D 61/185 125/21

(Continued)

FOREIGN PATENT DOCUMENTS

GB 1214393 A 12/1970
WO WO-02/074492 A2 9/2002

(Continued)

OTHER PUBLICATIONS

International Search Report issued PCT Patent Application No. PCT/EP2016/073177 dated Dec. 7, 2016.

(Continued)

*Primary Examiner* — Pegah Parvini
(74) *Attorney, Agent, or Firm* — Marshall, Gerstein & Borun LLP

(57) ABSTRACT

An abrasive sawing or polishing substrate includes a substrate, a binder C1 covering at least a portion of the substrate, and abrasive particles having an at least partial coating, C2. The abrasive sawing or polishing substrate also includes a coating C3 coating binder C1 and the abrasive (Continued)

particles coated with C2 and at least one light-emitting compound. The abrasive particles coated with C2 are in contact with binder C1 and with coating C3.

9 Claims, 4 Drawing Sheets

(56) References Cited

U.S. PATENT DOCUMENTS

2011/0039070 A1* 2/2011 Liebelt ..... B23D 61/185
428/143
2014/0290147 A1* 10/2014 Seth ..... B24D 18/0054
51/298

FOREIGN PATENT DOCUMENTS

WO WO-2010/057076 A2 5/2010
WO WO-2014/184457 A1 11/2014

OTHER PUBLICATIONS

Written Opinion of the International Searching Authority issued in PCT Patent Application No. PCT/EP2016/073177 dated Dec. 7, 2016.

* cited by examiner

LUMINESCENT SUBSTRATE CONTAINING ABRASIVE PARTICLES, AND METHOD FOR THE PRODUCTION THEREOF

FIELD OF TECHNOLOGY

The present disclosure relates to a substrate, for example, a wire, containing abrasive particles and a light-emitting compound.

The field of use of the presently described embodiments particularly concerns the sawing and the polishing of materials such as silicon, sapphire, or silicon carbide.

BACKGROUND

Generally, abrasive devices are manufactured by arranging abrasive particles on a substrate by means of a binder.

This technique enables to obtain sawing or polishing devices, for example, polishing pads, cutting or polishing wheels, or cutting wires.

The binder enables to attach the abrasive particles to the substrate. It is generally made of resin or of metal.

However, the absence of contrast and of relief between the particles and the substrate complicates any accurate monitoring of the wearing of abrasive devices.

SUMMARY OF THE DISCLOSURE

The described embodiments enable to solve this problem by integrating a light-emitting compound within an abrasive device.

The Applicant has developed an abrasive device integrating at least one light-emitting compound to ease the monitoring of its surface condition.

Thus, it is possible to control the condition of the abrasive device at the end of its manufacturing, but also during its use, and thus to replace it at the right time.

More specifically, the disclosed embodiments relate to an abrasive sawing or polishing substrate, comprising:

a substrate;

a binder C1 covering at least a portion of the substrate;

abrasive particles having an at least partial coating, C2;

a coating C3 at least partly covering binder C1 and the abrasive particles coated with C2;

at least one light-emitting compound.

In this abrasive substrate, the abrasive particles coated with C2 are in contact with binder C1 and with coating C3.

Further, and advantageously, binder C1 integrally covers the substrate, coating C2 integrally covers the abrasive particles, coating C3 integrally covers binder C1 and the abrasive particles. These properties of course concern a new abrasive substrate, before any use.

The substrate may particularly be selected from the group comprising: a steel wire; a textile; and a metal plate. It may be a sawing wire, a polishing textile, or a grinding wheel, for example.

Advantageously, the substrate is a wire comprising a steel core and having a circular cross-section, advantageously a steel wire having a diameter in the range from 60 micrometers to 1.5 millimeter.

It will be within the abilities of those skilled in the art to adapt the diameter of the core of the steel wire according to the material to be cut. Thus, a core having a diameter in the range from 200 micrometers to 1 millimeter is particularly adapted to cut silicon bricks in ingots. However, a core having a diameter in the range from 70 to 200 micrometers is particularly adapted to cut silicon wafers in bricks.

The wire core generally appears in the form of a wire having a tensile strength advantageously greater than 2,000 or 3,000 MPa, but, generally, smaller than 5,000 MPa.

On the other hand, the core may have an elongation at break, that is, the increase of the length of the core before it breaks, advantageously greater than 1%, more advantageously still greater than 2%. However, it remains preferably smaller than 10 or 5%.

Advantageously, the wire core is made of an electrically-conductive material, that is, a material having a resistivity lower than $10^{-5}$ ohm·m at 20° C., and particularly steel.

The steel core may in particular be made of a material selected from the group comprising carbon steel, ferritic stainless steel, austenitic stainless steel, and brass-plated steel. Carbon steel preferably contains from 0.6 to 0.8% by weight of this element.

Binder C1 enables to attach the abrasive particles to the substrate.

Binder C1 is preferably metallic. It may in particular be made of a nickel and/or cobalt layer, for example a nickel/cobalt alloy having a cobalt content in the range from 20% to 85% by weight with respect to the weight of the Ni/Co alloy, advantageously from 37 to 65%.

"Layer" means a film covering the substrate, having a homogeneous composition.

Advantageously, coating C3 is also metallic. It may in particular be made of a nickel and/or cobalt layer, for example, of a nickel/cobalt alloy having a cobalt content in the range from 10 to 90% by weight with respect to the weight of the Ni/Co alloy, advantageously from 20% to 85%, more advantageously from 37 to 65%.

However, binder C1 and coating C3 are advantageously made of metals or of metal alloys, for example, Ni/Co, different from one another.

Thus, binder C1, in contact with the substrate, may have a hardness greater than that of coating C3, to ascertain that the abrasive particles are maintained on the substrate.

Coating C3 is generally very resistant to abrasion, but also ductile to avoid cracking. Such a cracking problem may be encountered when the substrate is a wire, and more specifically when the wire is mechanically tensioned. For this purpose, it is preferable for coating layer C3 to have a sufficient ductility. On this regard, it can be observed whether the ductility of the external layer is sufficient by submitting the wire to a simple tensile test, until it breaks.

According to a specific embodiment, binder C1 and coating C3 are made of a nickel/cobalt alloy, having a cobalt content in the range from 20% to 85% by weight with respect to the weight of the Ni/Co alloy (independently from C1 to C3). In this case, coating C3 is advantageously made of a Ni/Co alloy containing more cobalt than binder C1. Thus, coating C3 has better abrasion resistance properties due to the high cobalt content. Further, coating C3 has hardness properties greater than those of the alloy of binder C1 due to its adapted composition, layer C3 being harder than layer C1 due to a higher cobalt content.

According to another specific embodiment, the hardness of binder C1 or of coating C3, particularly made of a Ni/Co alloy, may be improved by introduction of sulfur. This may in particular be implemented according to the method described hereafter, by introduction of sodium saccharin ($C_7H_4NO_3S$, Na, $2H_2O$) into an electrolyte bath enabling to form the layer of binder C1 or of coating C3.

Thus, binder C1 and/or coating C3, for example, made of a Ni/Co alloy, may contain from 100 to 1,000 ppm (parts per million) by weight of sulfur, preferably from 300 to 700 ppm by weight.

It is preferable that only binder C1 contains sulfur. Indeed, the addition of sulfur increases the binder hardness, but it decreases its ductility. A high sulfur content of coating C3 may cause a cracking thereof, particularly when the substrate is a wire which is tensioned in the cutting area. Such a cracking gives way to water and it places the substrate in electrolytic contact with the binder. This results in a corrosion of the substrate, which progressively becomes useless.

Binder C1 and coating C3 may particularly be obtained by successive electrolytic depositions of metals, and more particularly of Ni/Co-type metal alloys.

The metal layers forming binder C1 and coating C3 advantageously have a hardness in the range from 300 and 800 Hv, advantageously from 300 to 500 Hv.

The hardness of a metal or metal alloy layer (C1 and C3) is measured by means of a micro-hardness tester according to techniques within the general knowledge of those skilled in the art. A Vickers indenter is generally used, with a load compatible with the layer thickness. Such a load is generally in the range from 1 gram-force to 100 grams-force. If the mark left by the Vickers indenter is too large as compared with the layer thickness (even with a small load), a Knoop indenter (narrower) may be used, and the Knoop hardness value may be converted into Vickers hardness, by means of a conversion table.

As already indicated, the abrasive particles are coated with a layer of C2. Coating C2 is advantageously metallic, more advantageously made of a material selected from the group comprising nickel, cobalt, iron, copper, and titanium.

On the other hand, the abrasive particles are advantageously made of a material selected from the group comprising silicon carbide SiC; silica $SiO_2$; tungsten carbide WC; silicon nitride $Si_3N_4$; cubic boron nitride cBN; chromium dioxide $CrO_2$; aluminum oxide $Al_2O_3$; diamond; and diamonds pre-coated with nickel, iron, cobalt, copper, or titanium, or with alloys thereof.

According to a specific embodiment, the abrasive substrate may comprise a plurality of different types of abrasive particles.

It will be within the abilities of those skilled the art to select the adequate binder C1/abrasive particle combination according to the use of the abrasive substrate, for example, according to the material to be cut when the abrasive substrate is an abrasive wire.

The abrasive particles are formed of grains covered with a coating C2, which may be different from binder C1 and from coating C3. Coating C2 at least partially covers each grain, advantageously integrally. The materials covering the grains, such as diamond grains are for example nickel, cobalt, iron, copper, or titanium.

The total diameter of the particles, that is, of the grain and of coating C2, is advantageously in the range from 1 micrometer to 500 micrometers. When the substrate is a steel wire, the particle diameter is preferably smaller than one third of the diameter of the steel wire core. Thus, according to a specific embodiment, the particle diameter may be in the range from 10 to 22 for a wire with a core having a 0.12-mm diameter.

Diameter means the largest diameter (or the largest dimension) of the particles when they are not spherical.

Advantageously, coating C2 covering the grain is made of a ferromagnetic material at the abrasive wire manufacturing temperature (electrolytic deposition of the abrasive particles—see the method described hereafter). Nickel, iron, and cobalt are examples thereof. Such metals may be alloyed, and they may also contain hardening elements such as sulfur and phosphorus. It should be noted that phosphorus decreases the ferromagnetism of nickel and that, in this case, its concentration should be limited.

Further, the material forming coating C2 is advantageously electrically conductive.

Coating C2 at least partially covers the abrasive particles, advantageously integrally. However, during the use of the abrasive substrate, the grain portion in contact with the material to be cut or to be polished comprises no coating, the latter being abraded from as soon as the first cutting operations, in the same way as coating C3.

The mass of coating C2, relative to the total mass of the coated particles, is advantageously in the range from 10% to 60%, particularly in the case of diamond grains.

Coating C2 may in particular be deposited on the grains prior to the use of the abrasive grains/particles in the method of manufacturing the abrasive substrate. Techniques which may be implemented for the deposition of a coating C2 on each of the grains especially include cathode sputtering, but also electrolysis, chemical vapor deposition (CVD), and electroless nickel plating.

Generally, from 5 to 50% of the surface of the abrasive substrate are occupied by abrasive particles, themselves being possibly covered with coating C3 when the wire is new.

As already indicated, the abrasive substrate comprises at least one light-emitting compound. This compound advantageously appears in the form of light-emitting particles, advantageously inorganic light-emitting particles, and more advantageously still fluorescent inorganic particles.

The inorganic light-emitting particles may advantageously be selected from the group comprising particles based on, and advantageously made of, metal oxide; metal sesquioxide; metal oxyfluoride; metal vanadate; metal fluoride, and mixtures thereof.

They may also be inorganic particles selected from the group comprising $Y_2O_3$; $YVO_4$; $Gd_2O_3$; $Gd_2O_2S$; $LaF_3$; and mixture thereof.

The particles are advantageously doped with one or a plurality of active centers from the lanthanide family or from the family of transition elements.

Further, light-emitting particles may be used in mixtures to create a luminescent optical code.

Advantageously, the light-emitting particles are doped with ions from the lanthanide family, advantageously europium. The intensity of the luminescence depends on the doping rate and may transit through a maximum. Thus, the doping of these particles may vary from 0.5 to 50% with respect to the number of metal moles forming the particles, more advantageously from 1 to 5%.

A plurality of markers, that is, a plurality of light-emitting particles, may be used to mark the substrate. In this case, the quantity of each type of incorporated particles may be different. Further, each type of particles may have its own signature. In other words, the substrate authentication may require detecting a plurality of particles at different wavelengths.

Thus, by varying the proportion of each of the different markers, a plurality of optical codes may be created in view of the relative intensity of the luminescent signals.

According to a specific embodiment, the particles may comprise, within a same particle, different optical signatures detectable at different wavelengths. They then are dual-signature or triple-signature particles, for example.

Generally, the particles may have a spherical, cubic, cylindrical, parallelepipedal shape.

The particle size is defined by their greatest average dimension, that is, by their diameter when they have a spherical shape, their average length when they are in the shape of rods.

Thus, the light-emitting particles are particles having an average size advantageously in the range from 4 to 1,000 nanometers.

According to a preferred embodiment, the particles are nanoparticles.

The average nanoparticle size advantageously is in the range from 4 to 100 nanometers, more advantageously still from 20 to 50 nanometers.

Further, the particles, and more advantageously the nanoparticles, may be encapsulated (coated), particularly in a polysiloxane or silicon oxide matrix. The new polysiloxane or silica surface may then be functionalized with organosilane coupling agents, such as substituted alkoxysilanes like aminopropyltriethoxysilane or derivatives from the same family. The forming of the polysiloxane surface or the functionalizing of this surface enables to improve the dispersion in the solvent and the particle stability in dispersions. Further, such surface modifications of the particles may affect the hydrophilic/hydrophobic character of the particles and thus modify the affinity and the diffusivity of the inorganic light-emitting particles within binder C1, coating C2, or coating C3. A better homogeneity of the light-emitting particle distribution can thus be obtained.

When the particles are coated, their average size also remains within the above-mentioned size ranges. Generally, the coating increases the average particle size by in the order of from 5 to 15 nanometers.

The abrasive substrate may comprise one or a plurality of light-emitting compounds. Thus, according to seven specific embodiments, the abrasive substrate may comprise one of the following combinations:

a light-emitting compound CL1 in binder C1;

a light-emitting compound CL2 in coating C2;

a light-emitting compound CL3 in coating C3;

two light-emitting compounds CL1 and CL2 respectively in binder C1 and in coating C2; CL1 and CL2 being different from each other;

two light-emitting compounds CL1 and CL3 respectively in binder C1 and in coating C3; CL1 and CL3 being different from each other;

two light-emitting compounds CL2 and CL3 respectively in coating C2 and in coating C3; CL2 and CL3 being different from each other;

three light-emitting compounds CL1, CL2, and CL3 respectively in binder C1, in coating C2, and in coating C3; CL1, CL2 and CL3 being different from one another.

The described embodiments also relate to a method enabling to prepare the abrasive substrate. The method comprises the steps of:

forming an abrasive substrate by electrodeposition on a substrate of a binder C1 and of possibly magnetic abrasive particles, by passing through an electrolyte bath $B_1$ containing abrasive particles, said abrasive particles having an at least partial coating, C2, binder C1 at least partially covering the substrate, advantageously integrally;

electrodeposition of a coating C3, by passing through an electrolyte bath $B_2$, coating C3 at least partially covering binder C1 and the abrasive particles, advantageously integrally, the abrasive particles being in contact with binder C1 and coating C3;

integrating at least one light-emitting compound in at least one layer from among binder C1, coating C2, or coating C3.

In this method, at least one light-emitting compound is integrated to the abrasive substrate. As already indicated, it may be integrated in binder CC1 and/or in coating C2 and/or in coating C3.

According to a specific embodiment, a light-emitting compound CL1 may be introduced into bath B1 to be incorporated in binder C1.

According to another specific embodiment, a light-emitting compound CL2 may be previously introduced into coating C2.

According to another specific embodiment, a light-emitting compound CL3 may be introduced into bath B2 to be incorporated in coating C3.

Generally, the light-emitting compound is introduced in the form of an aqueous solution of light-emitting nanoparticles or nanocolloids in a homogeneous aqueous solution (bath $B_1$ and/or bath $B_2$). The resulting aqueous solution is then submitted to the application of a known method of electrodeposition (or galvanic deposition) on a substrate.

When the light-emitting compound is integrated to binder C1 or to coating C3, its quantity may amount to from 0.05 to 5% by weight with respect to the weight of binder C1 or of coating C3, advantageously from 0.1 to 1%.

To provide such a doping, the light-emitting compound may have a concentration in the range from 0.01 to 5 g/100 in bath $B_1$ or $B_2$, advantageously from 0.5 to 1 g/100.

When the light-emitting compound is integrated to coating C2, its quantity may amount to from 0.05% to 5% by weight with respect to the weight of coating C2, advantageously from 0.1 to 1%.

Light-emitting compound CL2 is integrated in C2 due to an electrolyte bath where the abrasive particles covered with a metal layer advantageously deposited by CVD are plunged.

Advantageously, electrolyte baths $B_1$ and $B_2$ comprise metal ions forming binder C1 and coating C2. They may in particular comprise at least cobalt ions and/or nickel ions.

In practice, $Co^{2+}$ and $Ni^{2+}$ ions are generally introduced into baths $B_1$ and $B_2$. However, other degrees of oxidation may coexist, but they are generally by a very small concentration minority in electrolyte baths.

Advantageously, the method may also comprise at least one of the following steps, before the electrodeposition:

degreasing the substrate in an alkaline medium;

pickling the substrate in an acid medium.

Bath $B_2$ may have a composition in terms of metal ions, such as nickel and cobalt ions, different from that of bath $B_1$. Bath $B_2$ advantageously comprises no abrasive particles.

According to a specific embodiment, coating C3 may be made of pure cobalt, a metal with a good abrasion resistance.

According to a specific embodiment, coating C3 may be covered by one or a plurality of layers. The possible layer(s) covering coating C3 may be obtained either by repeating the passing through bath $B_2$, or by passing through at least another electrolytic bath comprising Co Hand Ni II ions.

Advantageously, baths $B_1$ and $B_2$, and, possibly, the other baths, comprise, independently from one another, from 1 to 150 g/L of cobalt II ions and from 50 to 150 g/L of nickel II ions.

On the other hand, bath $B_1$ comprises from 1 to 100 g/L of abrasive particles.

As already indicated, the hardness of binder C1 or of coating C3 may also be improved by incorporation of sulfur.

Thus, the sulfur may in particular be introduced by addition of sodium saccharin ($C_7H_4NO_3S$, Na, $2H_2O$) into electrolyte bath $B_1$ or $B_2$, advantageously only into $B_1$. The introduced quantity may be in the range from 1 to 10 g/l, advantageously in the order of 5 g/l.

On forming of binder C1 or of coating C3, the temperature of bath $B_1$ or $B_2$ is advantageously in the range from 60 to 90° C.

For further details relative to the method steps as well as to the device used, those skilled in the art will appeal to their technical knowledge and particularly to the content of document FR 2 988 628.

Once the abrasive substrate has been formed, it may be submitted to a lapping step which enables to improve the performance of the abrasive substrate at the end of the manufacturing by exposing the abrasive particles.

The presently described embodiments also relate to the use of the above-described abrasive substrate, to saw or polish a material capable of being selected, in particular, from the group comprising silicon, sapphire, and silicon carbide. The abrasive substrate may be used in the context of silicon wafer manufacturing.

It will be within the abilities of those skilled in the art to adapt the abrasive substrate according to the material to be cut or to be polished. More particularly, the abrasive particles are selected to be harder than the material to be cut or to be polished.

The contemplated embodiments and the resulting advantages will better appear from the following non-limiting drawings and examples, provided as an illustration thereof.

DETAILED DESCRIPTION

The presently described embodiments provide significant advantages in the regular control of the abrasive properties of the abrasive substrate.

Figure 1:
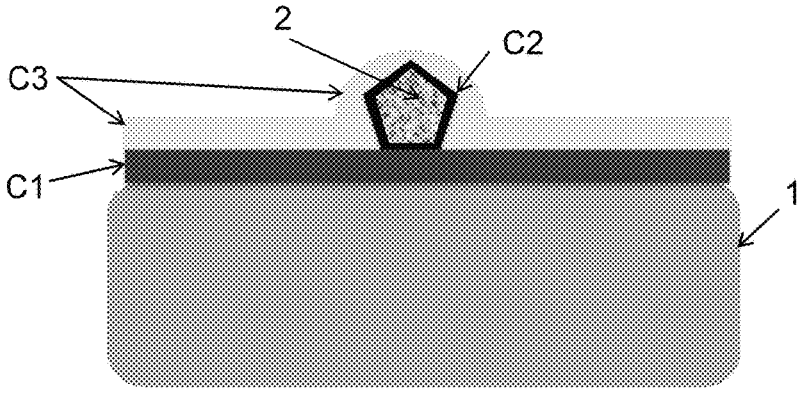
FIG. 1 illustrates a conventional abrasive wire.

FIG. 1 shows a substrate (1) comprising a sawing or polishing abrasive, comprising:

a substrate (1);

a binder C1 covering the substrate (1);

abrasive particles (2) having a coating C2;

a coating C3 coating binder C1 and the abrasive particles (2) coated with C2.

Figure 2:
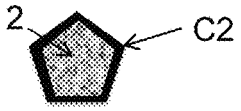
FIG. 2 illustrates a coated abrasive particle.

The abrasive particles (2) coated with C2 (FIG. 2) are in contact with binder C1 and with coating C3.

In embodiments, the abrasive substrate may comprise at least one light-emitting compound CL in binder C1 and/or in coating C2 and/or in coating C3.

Thus, to obtain different data relative to the abrasive substrate, the fluorescence signal may be dissociated on the three layers C1, C2, and C3.

Figure 3:
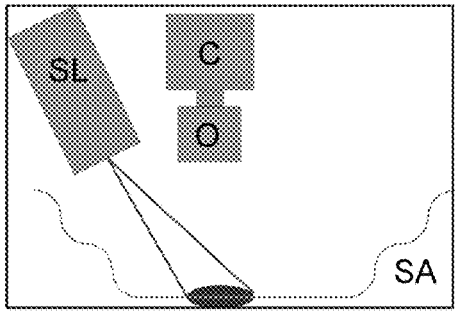
FIG. 3 illustrates a first device enabling to detect the luminescence of the abrasive wire.
Figure 4:
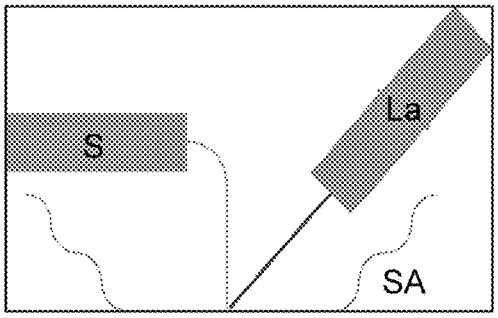
FIG. 4 illustrates a second device enabling to detect the luminescence of the abrasive wire.

As illustrated in FIGS. 3 and 4, the presence of light-emitting compound CL may be detected due to different devices. The quality control and the wear monitoring of the abrasive substrate may be followed-up by means of these devices which can excite the light-emitting compounds, coupled to the acquisition of images. It is thus possible to verify the number of diamonds at the end of the manufacturing or on use of the abrasive substrate.

The system of acquisition/observation of the luminescence according to FIG. 3 comprises a camera C and a lens O provided with a bandpass filter to select the emission wavelength of the light-emitting compound integrated to the abrasive substrate.

The emission of the light-emitting compound may be ensured by exposure of the abrasive substrate SA to a filtered light source SL.

The luminescence acquisition system of FIG. 4 comprises an optical fiber spectrometer S, the illumination (excitation of the light-emitting compound) being performed by a laser La with a selected wavelength and a sufficiently fine spectrum width to avoid any parasitic signal.

When abrasive substrate SA comprises a plurality of light-emitting compounds, one or a plurality of excitation sources may be used to detect all the light-emitting compounds present in abrasive substrate SA. In this case, an image acquisition system comprising one or a plurality of optical filters may be used, the filters only letting through the desired wavelengths for the abrasive substrate quality or wear measurement.

The quantification of the detected signal is ensured by a calibration of the system with wear gauges for the abrasive substrate to define two main thresholds, a high and a low threshold.

On the other hand, it is preferably to clean the abrasive substrate prior to measuring its luminescence. Such a cleaning enables to do away with possible parasitic signals due to cutting or polishing dust. It may be performed by high pressure water jet just before the acquisition area, which is itself located outside of the cutting or polishing area.

Thus, the measurement of the luminescence of the abrasive substrate may be performed from a device, for example, according to FIG. 3 or 4, installed:

at the output of the manufacturing machine, by stopping the advancement during the acquisition time to monitor the quality of the abrasive substrate; or in the cutting or polishing area to monitor the wearing of the abrasive substrate. For an abrasive wire, it may be the winding and unwinding chamber of an industrial wire cutting machine (for example, for solar wafers), where the luminescence measurement may occur each time the wire direction changes during the cutting.

Figure 5:
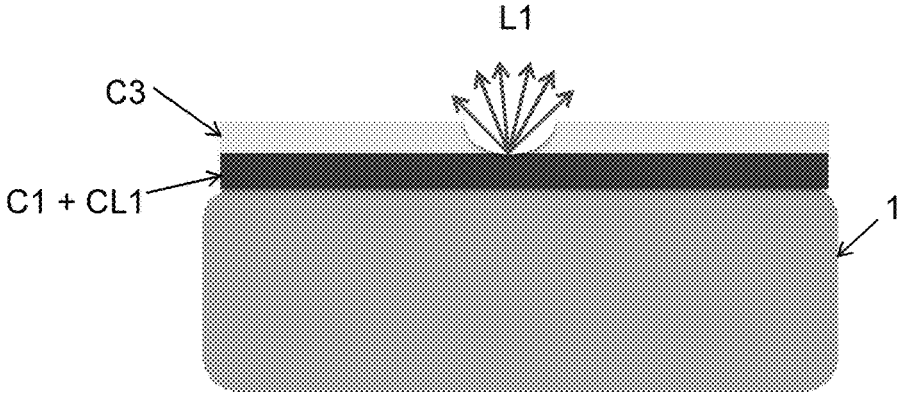
FIG. 5 illustrates the luminescence of the abrasive wire according to a specific embodiment.

FIG. 5 corresponds to a specific embodiment in which the abrasive substrate comprises a light-emitting compound CL1 in binder C1.

Generally, the abrasive substrate is replaced as soon as signal L1 reaches a predefined threshold corresponding to a wear rate which does not enable it to carry out its sawing of polishing function. A calibration of the control device enables to define this threshold.

Such a configuration enables to monitor the wearing of the abrasive substrate by monitoring the occurrence of signal L1 corresponding to the emission of light-emitting compound CL1. This signal appears as soon as abrasive particles (2) are torn from the substrate (1).

This embodiment (CL1 in C1) is particularly adapted to a substrate of diamond grinding wheel type which requires a regular dressing to expose the abrasive particles in order to keep its abrasive power. The presence of a light-emitting compound in binder C1 enables to indicate the end of the tool lifetime.

Figure 6:
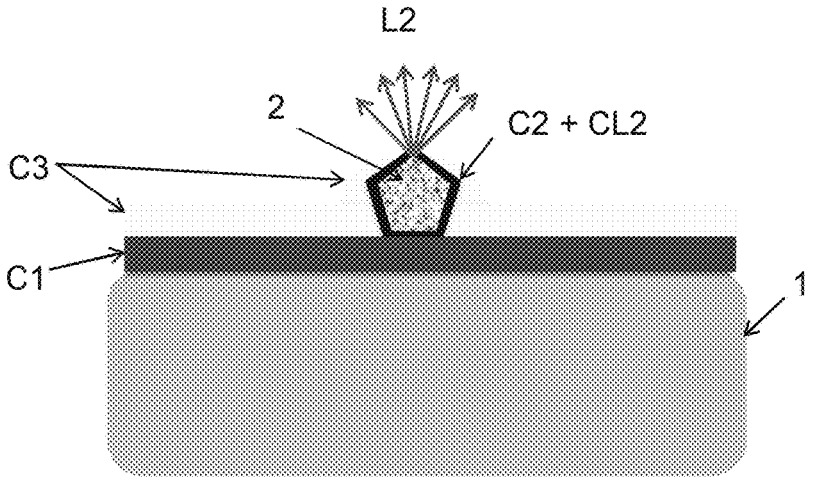
FIG. 6 illustrates the luminescence of an abrasive wire according to a specific embodiment.

FIG. 6 corresponds to a specific embodiment in which the abrasive substrate comprises a light-emitting compound CL2 in coating C2.

During its use, the wearing of the abrasive substrate may be monitored by supervising the decrease of signal L2. However, the small quantity of layer C2 and thus of CL2 around the particles has the disadvantage of limiting the dynamic range of the measurement.

This embodiment is particularly adapted to a textile substrate. For example, in a polishing pad, the presence of a light-emitting compound in coating C2 enables to control the abrasive quality of the pad. A strong decrease in the signal emitted by the light-emitting compound then corresponds to a decrease in the abrasive properties resulting from the loss of abrasive particles. It is then necessary to replace the pad.

Figure 7:
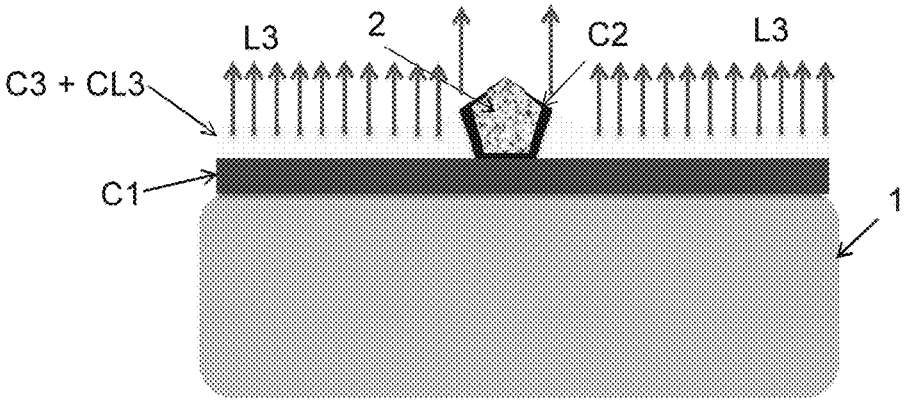
FIG. 7 illustrates the luminescence of an abrasive wire according to a specific embodiment.

FIG. 7 corresponds to a specific embodiment in which the abrasive substrate comprises a light-emitting compound CL3 in coating C3.

In this configuration, the presence of light-emitting compound CL3 in coating C3 enables to create a contrast between CL3 and abrasive particles C2.

The luminescence signal originates from coating C3. No signal can be observed at the level of the diamonds when they have been lapped, that is, deprived of coating C3. Such a configuration enables to monitor the wearing of the wire due to a predefined low signal threshold controlling the stopping of the machine as soon as the threshold has been reached.

The abrasive substrate may also simultaneously comprise two or three light-emitting compounds from among CL1 (in C1), CL2 (in C2), and CL3 (in C3).

This embodiment enables to improve the monitoring of the quality and of the wearing of the abrasive substrate from its manufacturing to its change.

This embodiment is particularly adapted to substrates of diamond polishing support type. In this case, binder C1 and/or coating C2 of the abrasive particles may respectively comprise light-emitting compounds CL1 and CL2. The emission of CL1 and/or the absence or decrease of the emission of CL2 show(s) the decrease of the abrasive power, triggering the replacement of the abrasive substrate.

ILLUSTRATIVE EMBODIMENTS

The following examples illustrate the forming, on a metal substrate, a) of a binder C1 comprising a light-emitting compound CL1, b) of a coating C3 comprising a light-emitting compound CL3.

a) Forming of a binder C1 comprising abrasive particles and a light-emitting compound CL1 (INV-1).

A solution containing abrasive particles, a light-emitting compound, and metal ions has been prepared as follows:

preparation of a first solution containing 500 ml of deionized water, 600 g/l of nickel salt (nickel sulfate), and from 5 to 60 g/l of abrasive particles;

preparation of a second aqueous solution of 200 ml of a solution of cationic nanocolloids ($YVO_4$:Eu) at 4 g/l;

forming of an electrolyte bath by mixture of the first and of the second solutions;

adjustment to pH=2 by addition of sulfamic acid.

Once the first and second solutions have been mixed, the galvanic treatment is performed on a brass substrate, at a 50° C. temperature.

The galvanic deposition is performed under mechanical stirring of the electrolyte bath to maintain the particle dispersed in the solution.

The electrodeposition is performed by flowing of a current between two electrodes in the aqueous electrolytic bath. The substrate to be covered corresponds to one of the electrodes (cathode). It will be within the abilities of those skilled in the art to determine the nature (intensity, potential) of the current to be applied, according to the geometry, to the distance between electrodes, to the nature of the metal ions, or to their concentration in the solution (see, in particular: Traité de Galvanotechnique, Louis Lacourcelle, 1997, Galva-Conseils Edition).

The current flow conditions, the reaction time, and the geometry of the electrodes in the bath are interdependent and are determined to obtain a layer having a 4-micrometer width covering the cathode surface at the end of the deposition time (1 minute).

Figure 8:
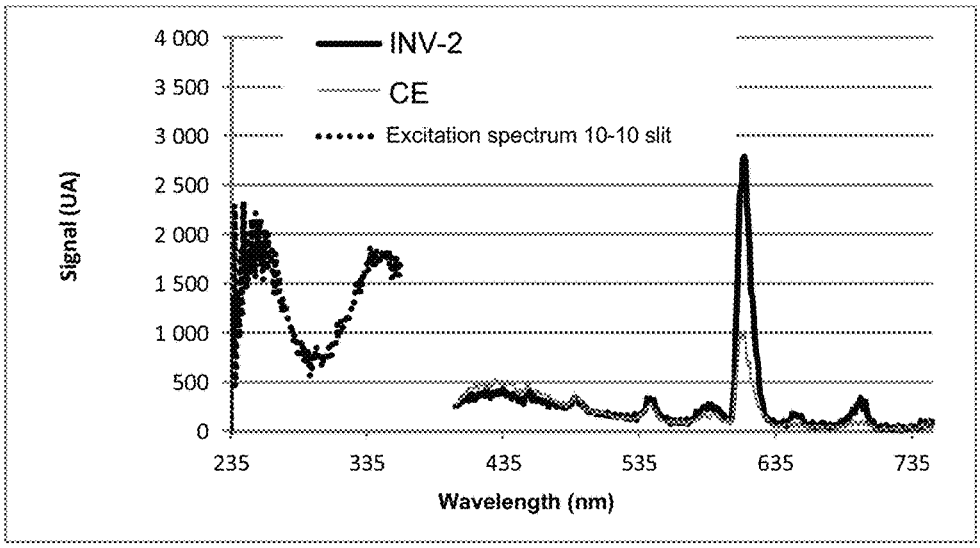
FIG. 8 corresponds to the emission spectra of a wafer treated with a galvanic deposition solution containing fluorescent particles.

Such conditions enable to obtain a homogeneous deposition of binder C1 comprising abrasive particles and a light-emitting compound CL1.

b) Forming of a coating C3 comprising a light-emitting compound CL3 (INV-2, FIG. 8).

The protocol described for binder C1 has been followed, this time in the absence of abrasive particles in the first solution containing the nickel salt.

The solution thus prepared is homogeneous. It is not a dispersion requiring a permanent stirring. Further, the solution of cationic nanocolloids used has a behavior of migration to the cathode similar to that of the metal ions used in the solution to form a metal deposition under the influence of a galvanic current.

Such conditions enable to obtain a homogeneous deposition of coating C2 comprising a light-emitting compound CL2.

c) Counter-example (CE, FIG. 8)

This counter-example comprises:

mixing a dispersion of powders of light-emitting compounds having a submicrometer- and micrometer-range dispersity;

maintaining the dispersion in solution by stirring; and performing the galvanic deposition on a brass substrate.

The resulting substrate exhibits fluorescent areas, however very heterogeneously distributed.

Examples a) to c) show the importance of preparing the electrolyte bath by mixture between the light-emitting components in the form of an aqueous solution and a solution containing the precursor metal salts for the metal deposition.

The solution of light-emitting compounds does not disturb the migration of the ions and of the nanoparticles in homogeneous solution under the effect of current. It is possible to form a smooth metal surface. However, the presence of particles in suspension disturbs the deposition of the metal layer, making it rough, heterogeneous, and discontinuous.

The third curve of FIG. 8 enables to optimize the excitation of the light-emitting compound for a better efficiency.

The invention claimed is:

1. An abrasive sawing or polishing substrate, comprising:

a substrate;

a binder C1 covering at least a portion of the substrate;

abrasive particles having an at least partial coating, C2;

a coating C3 coating binder C1 and the abrasive particles coated with C2;

at least one light-emitting compound;

the abrasive particles coated with C2 being in contact with binder C1 and with coating C3, and wherein the substrate is selected from the group comprising: a steel wire; a textile;

and a metal plate;

wherein binder C1 is made of at least one layer of a nickel/cobalt alloy having a cobalt content in the range from 20% to 85% by weight with respect to the weight of the Ni/Co alloy;

wherein coating C2 of the abrasive particles is made of a material selected from the group comprising nickel; cobalt; iron; copper; and titanium;

and wherein coating C3 is made of at least one layer of a nickel/cobalt alloy having a cobalt content in the range from 10% to 90% by weight with respect to the weight of the Ni/Co alloy.

2. An abrasive sawing or polishing substrate, comprising:

a substrate;

a binder C1 covering at least a portion of the substrate;

abrasive particles having an at least partial coating, C2;

a coating C3 coating binder C1 and the abrasive particles coated with C2;

at least one light-emitting compound:

the abrasive particles coated with C2 being in contact with binder C1 and with coating C3, wherein said substrate comprises a light-emitting compound CL1 in binder C1.

3. An abrasive sawing or polishing substrate, comprising:

a substrate;

a binder C1 covering at least a portion of the substrate;

abrasive particles having an at least partial coating, C2;

a coating C3 coating binder C1 and the abrasive particles coated with C2;

at least one light-emitting compound:

the abrasive particles coated with C2 being in contact with binder C1 and with coating C3, wherein said substrate comprises a light-emitting compound CL2 in coating C2.

4. An abrasive sawing or polishing substrate, comprising:

a substrate;

a binder C1 covering at least a portion of the substrate;

abrasive particles having an at least partial coating, C2;

a coating C3 coating binder C1 and the abrasive particles coated with C2;

at least one light-emitting compound:

the abrasive particles coated with C2 being in contact with binder C1 and with coating C3, wherein said substrate comprises a light-emitting compound CL3 in coating C3.

5. The abrasive substrate of claim 1, wherein the substrate comprises:

a light-emitting compound CL1 in binder C1;

a light-emitting compound CL2 in coating C2;

a light-emitting compound CL3 in coating C3;

CL1, CL2, and CL3 being different from one another.

6. The abrasive substrate of claim 1, wherein the abrasive particles are made of a material selected from the group comprising silicon carbide SiC; silica $SiO_2$; tungsten carbide WC; silicon nitride $Si_3N_4$; cubic boron nitride cBN; chromium dioxide $CrO_2$; aluminum oxide $Al_2O_3$; diamond; and diamonds pre-coated with nickel, iron, cobalt, copper, or titanium, or with alloys thereof.

7. The abrasive substrate of claim 1, wherein the light-emitting compound is selected from the group comprising metal oxide; metal sesquioxide; metal oxyfluoride; metal vanadate; metal fluoride; and mixtures thereof.

8. A method of manufacturing an abrasive sawing or polishing substrate having (i) a substrate, (ii) a binder C1 covering at least a portion of the substrate, (iii) abrasive particles having at least a partial coating, C2, (iv) a coating C3 coating binder C1 and the abrasive particles coated with C2, and (v) at least one light-emitting compound, wherein the abrasive particles coated with C2 are in contact with binder C1 and with coating C3, the method comprising the steps of:

forming of an abrasive substrate by electrodeposition on a substrate of a binder C1 and of abrasive particles, by passing through an electrolyte bath $B_1$ containing abrasive particles, said abrasive particles having an at least partial coating, C2, binder C1 at least partially covering the substrate;

electrodeposition of a coating C3, by passing through an electrolyte bath $B_2$, coating C3 at least partially covering binder C1 and the abrasive particles, the abrasive particles being in contact with binder C1 and coating C3;

integration of at least one light-emitting compound in at least one layer from among binder C1, coating C2, or coating C3, wherein the substrate is selected from the group comprising: a steel wire; a textile; and a metal plate;

wherein binder C1 is made of at least one layer of a nickel/cobalt alloy having a cobalt content in the range from 20% to 85% by weight with respect to the weight of the Ni/Co alloy;

wherein coating C2 of the abrasive particles is made of a material selected from the group comprising nickel; cobalt; iron; copper; and titanium;

and wherein coating C3 is made of at least one layer of a nickel/cobalt alloy having a cobalt content in the range from 10% to 90% by weight with respect to the weight of the Ni/Co alloy.

9. The method of manufacturing the abrasive substrate of claim 8, wherein the light-emitting compound is introduced in the form of an aqueous solution of light-emitting nanoparticles or nanocolloids into bath $B_1$ or $B_2$.

* * * * *